US006582267B1

(12) United States Patent
Steger

(10) Patent No.: US 6,582,267 B1
(45) Date of Patent: Jun. 24, 2003

(54) PERSONAL FLOTATION DEVICE

(75) Inventor: Ralph E. Steger, Baxley, GA (US)

(73) Assignee: Hedstrom Corporation, Arlington Heights, IL (US)

( * ) Notice: Subject to any disclaimer, the term of this patent is extended or adjusted under 35 U.S.C. 154(b) by 0 days.

(21) Appl. No.: 10/008,714

(22) Filed: Dec. 7, 2001

(51) Int. Cl.[7] ..... B63C 9/08
(52) U.S. Cl. ..... 441/112
(58) Field of Search ..... 441/88, 84, 89, 441/80, 106, 108, 111, 112

(56) References Cited

U.S. PATENT DOCUMENTS

| | | | | | |
|---|---|---|---|---|---|
| 906,109 | A | * | 12/1908 | Cooke | 441/111 |
| 1,154,860 | A | * | 9/1915 | Hendry | 441/111 |
| 1,366,346 | A | * | 1/1921 | Bailey | 441/111 |
| 2,807,035 | A | | 9/1957 | Phillips | |
| 3,261,042 | A | | 7/1966 | Baker | |
| 3,360,813 | A | | 1/1968 | Baker | |
| 4,123,814 | A | * | 11/1978 | Ettinger | 441/111 |
| 4,194,257 | A | | 3/1980 | Martin | |
| 4,308,629 | A | * | 1/1982 | Freemon | 441/111 |
| 4,380,441 | A | * | 4/1983 | Harr et al. | 441/112 |
| RE32,023 | E | | 11/1985 | Harr et al. | |
| 4,555,234 | A | | 11/1985 | Kent | |
| 4,799,908 | A | | 1/1989 | Lucius | |
| D361,115 | S | | 8/1995 | Lucius | |
| 5,662,433 | A | * | 9/1997 | Seligman | 441/106 |
| 5,690,413 | A | * | 11/1997 | Coughlin | 441/106 |
| D410,987 | S | | 6/1999 | Lucius | |
| D422,666 | S | | 4/2000 | Wagner | |
| 6,120,213 | A | * | 9/2000 | Stinton | 441/111 |

* cited by examiner

*Primary Examiner*—S. Joseph Morano
*Assistant Examiner*—Lars A. Olson
(74) *Attorney, Agent, or Firm*—Vedder Price Kaufman & Kammholz

(57) ABSTRACT

A personal flotation device is provided with a shell including a pair of elements joined to form a continuous pocket for receiving buoyant materials. The shell has a first end portion, a second end portion, and an intermediate portion. The first and second end portions have a first part and a second part. Each second part has a strap connected thereto, such that the straps extend away from the second parts to a first coupler defining a neck hole. The intermediate portion has a strap extending away therefrom to a second coupler. Connecting the first and second couplers defines a pair of opposing armholes.

27 Claims, 4 Drawing Sheets

PERSONAL FLOTATION DEVICE

BACKGROUND OF THE INVENTION

The present invention generally relates to flotation vests classified by the United States Coast Guard as Type III—Flotation Aid. More particularly, the present invention relates to a new and improved Type III flotation vest which accommodates a range of torso lengths, and provides uncompromised upper body range of motion for improved safety.

Buoyant vests or personal flotation devices ("PFD") are well known. A common PFD is bright orange in color and is shaped like an inverted U or horseshoe. Frequently referred to as "life preservers" in the past, conventional vests of this type include three interconnected tubular or cylindrical flotation segments. A horizontal, top or upper cross piece is adapted to be placed behind the head and two spaced apart vertical segments are hingedly attached to opposed ends of the top piece. The front vertical segments are adapted to pass from behind the head across the shoulders forwardly and downwardly along the chest to about the wearer's waist. A waist strap has one end connected to one of the vertical segments and encircles the wearer. The belt free end is threaded through a belt loop on the other vertical segment and fastened, usually by a spring clip to a belt ring on the other vertical segment. The belt also usually includes a cinch buckle to adjust the length of the belt. A pair of tie straps are usually aligned about chest height on each of the vertical segments lobes for forming a chest tie which effectively connects the vertical segments to define a neck hole or opening. These tie straps are usually made of a woven, non-slip fabric material, such as cotton. More than one pair of tie straps may be disposed on along the front portions of the vest. In these conventional flotation vests, each segment is filled with a flotation material for buoyancy. The filling may be a closed cell foam material in chopped, molded or sheet form or kapok.

Conventional life vests of this type have proven themselves useful and are perfectly adequate for most adult uses on or near the water. Nevertheless, special difficulties arise these conventional vests when the wearer actively engages in water sports. More particularly, the thick profile and bulky configuration, specifically the behind-the-head portion, inhibits and interferes with the natural articulation of limbs or appendages. Further, the encircling strap is not adequately secured about the wearer's body. A conventional flotation vest design generally includes a front, vertical flotation segment secured to the wearer's upper body which cause most wearers falling face first into the water to roll over into a chest-raised, back float position. The behind-the-head flotation segment raises the head, face and ears of the wearer out of the water, and permits a person to remain in the water for a long period of time without becoming exhausted or drowning. This design or style is effective for its intended purpose, namely, preserving the wearer's life by keeping the head above water. However, a conventional vest of this design has a major disadvantage. It is not designed to accommodate today's active water sports participants.

Other conventional vests have removed the behind-the-head segment and replaced it with a back element. As a result, the range of movement is limited and they are hot and uncomfortable to wear. These conventional vests are less effective than earlier designs and can only be effective if they are properly worn and remain in position under circumstances likely to be encountered in use. Active participation in modern water sports tends to require considerable range of movement for the torso and limbs. As a result, the position and orientation of the conventional vests is altered to such an extent many participants become frustrated and fail to use them. These conventional vests afford greater range of motion than earlier designs, however, upper body movements are still limited by today's standards.

A current, commercially available embodiment of this other vest design includes a front zipper closure which separates the front flotation panel into left and right front flotation halves. This full vest design includes front-and back panels defining top neck and side arm holes. This PFD design seeks to distribute the buoyant material about the entire torso of the wearer. These newer designs are still hot and uncomfortable to wear during active participation in water sports. Further, the range of motion necessary is not permitted.

Therefore there remains a need for a PFD which qualifies as a U.S. Coast Guard Type III—Flotation Aid and provides improved comfort and mobility for the wearer actively engaged in water sports activities while maintaining required flotation abilities.

SUMMARY OF THE INVENTION

In one principal aspect of the present invention, a flotation vest includes a shell having a pair of front parts and a back part. A buoyancing means is disposed within an internal cavity defined in each of the front and back parts. The back part interconnects a first side of each of the front parts. Each front part has a torso portion and a lapel portion. A second side of each of the front parts is disposed for operative association with the other second side. A shoulder strap is connected to a first end of the lapel portion. A pair of shoulder straps extend from the lapel portions and terminate at a first coupling element such that a neck hole is defined. A back strap extends from the back part to engage the first coupling element such that a pair of oppositely disposed armholes are defined. Whereby the vest accommodates various differently dimensioned wearers and provides uninhibited arm motion.

In another principal aspect, the present invention provides a flotation vest including a shell having a pair of elements joined to form a continuous pocket full receiving a buoyancing means. The shell has a first end portion, a second end portion, and an intermediate portion. The first and second end portions have a first part and a second part. Each second part has a strap connected thereto. The pair of straps extend from the second part to a first coupler, thus defining a neck hole. The intermediate portion has a strap extending therefrom. Whereby, upon releasably connecting the intermediate strap with the first coupler, a pair of arm holes in opposition are defined.

BRIEF DESCRIPTION OF THE DRAWINGS

In the course of the following detailed description, reference will be made to the accompanying drawings wherein like reference numerals identify like parts and in which.

DETAILED DESCRIPTION OF A PREFERRED EMBODIMENT OF THE INVENTION

Figure 1:
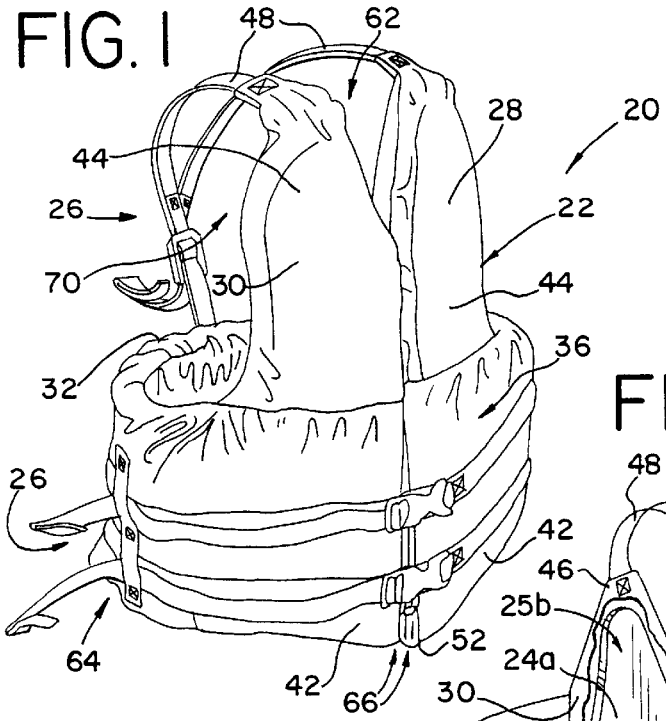
FIG. 1 is perspective view of a personal flotation device in accordance with the present invention.
Figure 2:
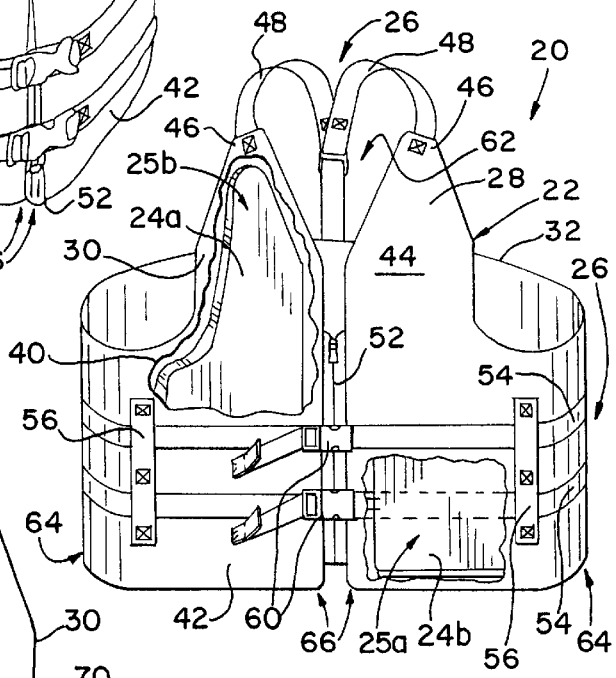
FIG. 2 is a front elevation view of the personal flotation device of FIG. 1 with a portion broken away showing a buoyant element.
Figure 3:
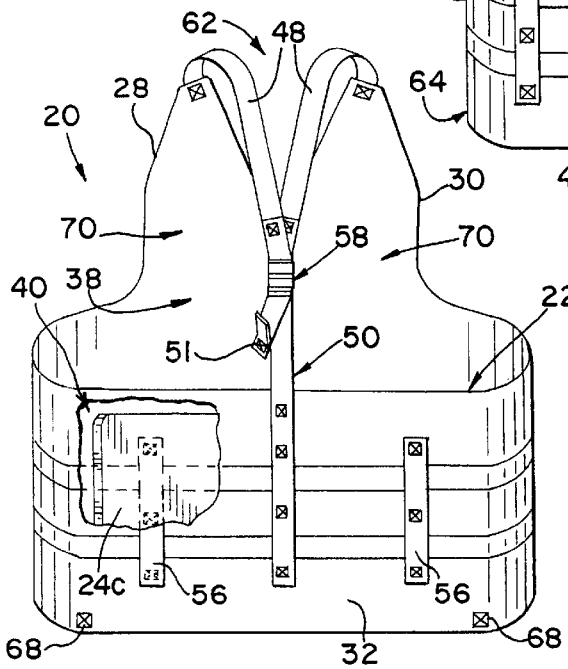
FIG. 3 is a rear elevation of the personal flotation device of FIG. 1 with a portion broken away showing a buoyant element.

FIGS. 1–3 illustrate a PFD 20 constructed in accordance with the principles of the present invention. The PFD includes a shell 22, buoyant elements 24*a*, 24*b*, and 24*c*, and securing elements 26. The shell 22 includes a pair of front parts 28 and 30, and a back part 32. The shell 22 is formed by a pair of elements 34 commonly referred to as an outer fabric layer 36 and an inner fabric layer 38. The fabric layers 36 and 38 are formed complimentary to one another and are connected along their commonly disposed edges, preferably by stitching or other suitable connection means. Generally, the layers 36 and 38 are formed complementary to one another and are connected along their commonly disposed edges, preferably by stitching or other suitable connection means. Generally, the layers 36 and 38 are formed of a woven fabric material, preferably coated or uncoated nylon, reinforced nylon, polyester or polypropylene woven fabrics and PVC-reinforced nylon and polypropylene woven fabric materials. It will be recognized by those of skill in the art that any other suitable material may be used. An internal cavity 40 is formed in connection with the front parts 28 and 30, and the back part 32 for disposing the buoyant elements 24*a*, 24*b* and 24*c* therein. Alternatively, the internal cavity 40 may be formed as a continuous pocket which extends from a first end portion 28, through an intermediate portion 32, to a second end portion 30 may be formed for ease of manufacture and installing the buoyant elements 24*a*, 24*b* and 24*c*.

The front parts or end portions 28 and 30 each have a first part or torso portion 42 and a second part or lapel portion 44. The torso portion 42 is configured to engage the wearer's torso generally below the chest region. A portion of each front buoyant element 24*a* and 24*b* includes a lower torso element 25*a* dimensioned to substantially occupy that portion of the internal cavity 40. The lapel portion or second part 44 is configured more narrowly than the torso part to engage the wearer's chest and shoulders. A first free end 46 of the lapel portion 44 is disposed adjacent the wearer's neck and shoulder when properly worn. The buoyant elements 24*a* and 24*b* include a lapel portion 25*b* dimensioned to substantially occupy the lapel portion of the internal cavity 40. Preferably each front buoyant element 24*a* and 24*b* is formed as a one-piece element by any available means, namely, solid core or single multi-fold sheet. However, it will be understood that multiple identically formed sheets in a stacked configuration may also be used to perform the same function. Either design is configured such that it is retained in position in the front parts or end portions 28 and 30 without additional connection to the PFD 20.

The front portions 28 and 30 each have a first side 64 and a second side 66. The first sides 64 are connected to the back, intermediate portion 32 such that the PFD 20 has a band circumferentially extending about the wearer generally adjacent the wearer's torso. Thus, a continuous pocket 40 is defined about the wearer from the second side of the first front portion 28 to the second front portion 30.

The back part or intermediate portion 32 extends between the sides 64 of the front portions 28 and 30, receives a buoyant element 24*c* and includes a back strap 50. Buoyant element 24*c* is preferably centrally disposed along the longitudinal extent of the back portion 32 and retained in such position by retaining elements 68 sewn into the back portion 32. The retaining elements 68 sufficiently decrease the size of the cavity 40 such that the buoyant element 24*c* cannot be displaced therefrom. The buoyant element 24*c* preferably has a longitudinal extent less than the longitudinal extent of the back portion 32 in order to provide the wearer an uninhibited full range movement in nearly any direction. The buoyant element 24*c* may be formed as a one-piece element by any available means, namely, solid core or a single multi-fold sheet. However, it will be understood that multiple identically formed sheets in a stacked configuration may also be used to perform the same function.

The securing elements 26 include shoulder straps 48, back strap 50, zipper 52, circumferential straps 54, loops 56, one-piece coupler 58 and two-part couplers 60. The shoulder straps 48 are connected at one end to the free end 46 of each lapel part 44, and at an opposite end to the one-piece coupler 58. Both shoulder straps 48 connect to the coupler 58 at the same point. Accordingly, a neck hole 62 is defined to receive the wearer's head and neck therethrough. The back strap 50 is generally centrally disposed within the back portion 32 such that when the PFD is installed on a wearer the back strap 50 is substantially collinear with the wearer's spine. The back strap 50 has a free end 51 which adjustably and variably engages the coupler 58, so that the PFD 20 may be comfortably and correctly worn by a large range of wearer's all having different body types and proportions. A pair of arm holes 70 are defined when the back strap 50 is interconnected via the coupler 58 with the shoulder straps 48.

Figure 4:
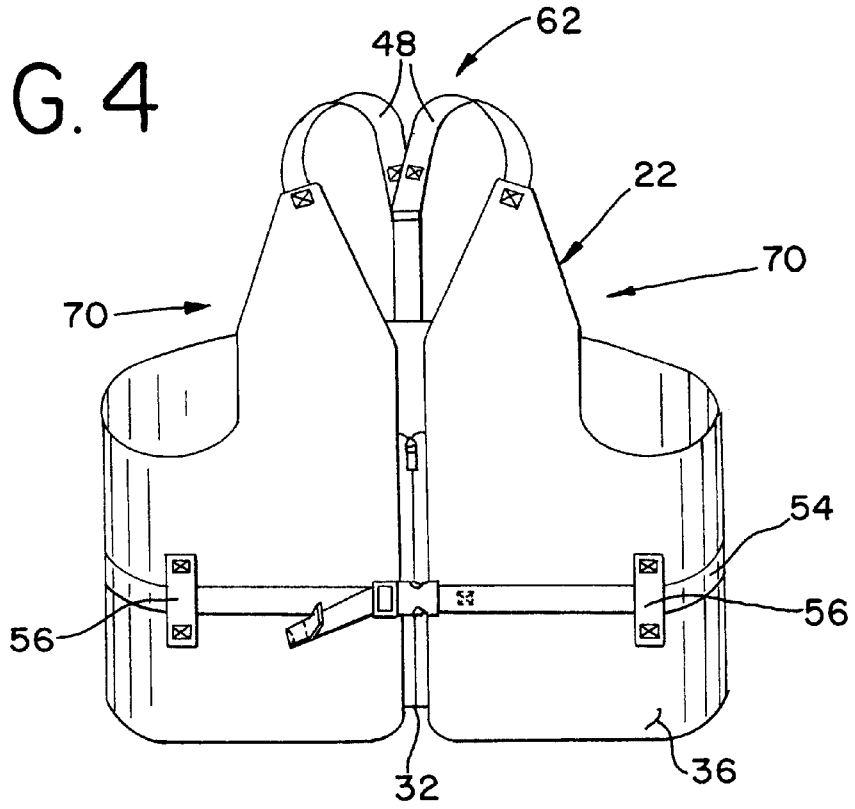
FIG. 4 is a front elevation view of alternative embodiment of the personal flotation device of FIG. 1.
Figure 5:
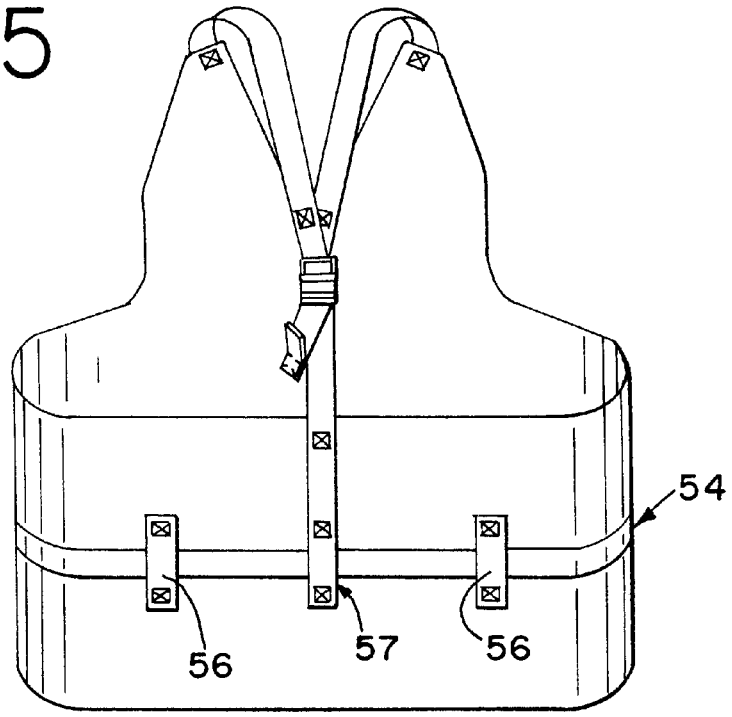
FIG. 5 is a rear elevation view of the alternative embodiment of the personal flotation device of FIG. 4.
Figure 6A:
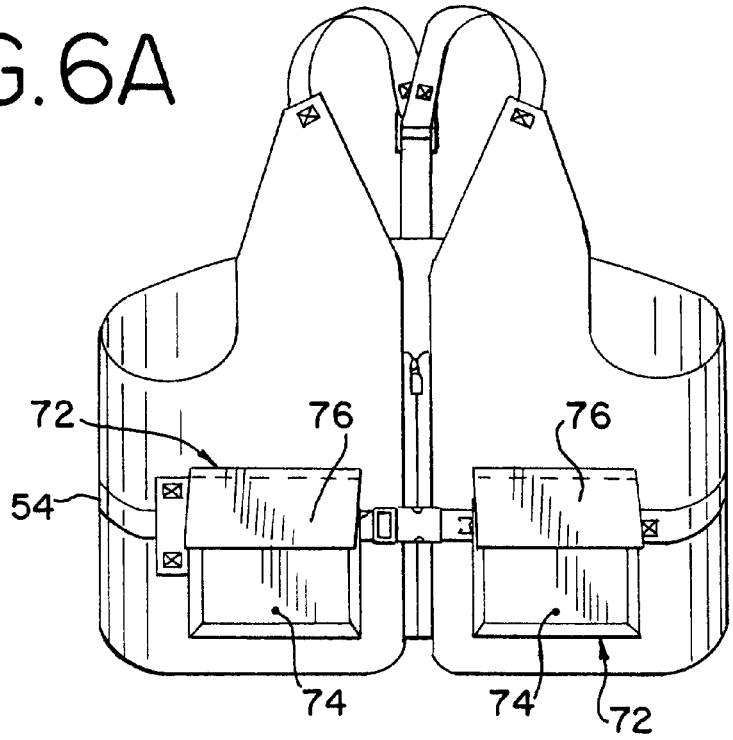
FIGS. 6A and 6B are front elevation views of alternative embodiments of the personal flotation device of FIG. 1 showing alternate front pockets.
Figure 6B:
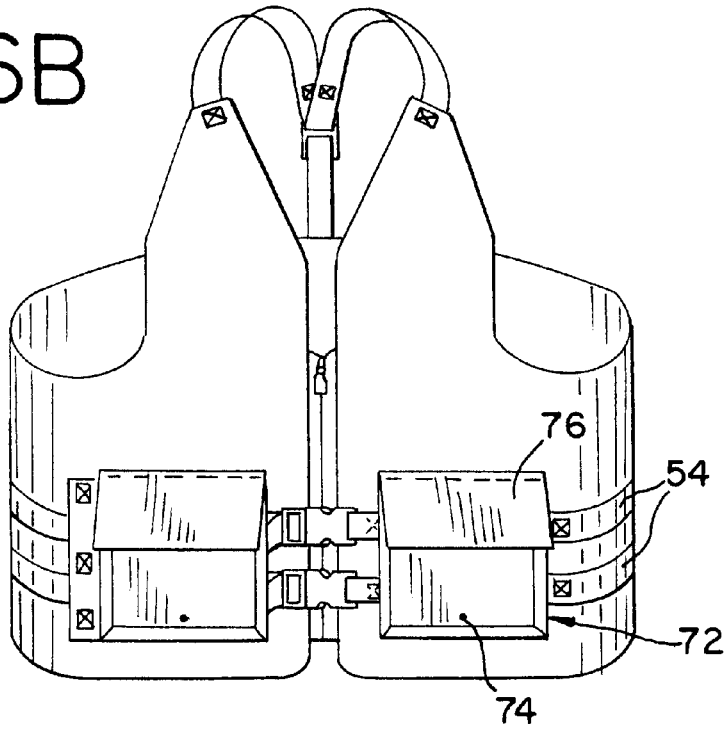

The zipper 52 is disposed along the second side 66 of each end portion 28 and 30. In accordance with conventional design operation of the zipper 52 connects or disconnects the front parts 28 and 30. The zipper 52 may be used independent of or in connection with the circumferentially extending straps 54, which have ends interconnected via two-part couplers 60 adjacent the zipper 52. As shown in FIGS. 4 and 5, the present invention may be alternatively used with a single circumferential strap 54. In either configuration, a plurality of loops 56 are affixed to the outer layer 36 of the shell 22 to ensure correct orientation and position of the straps 54. The end of the back strap 50 opposite the free end 57 may also form additional loops 56.

Figure 7:
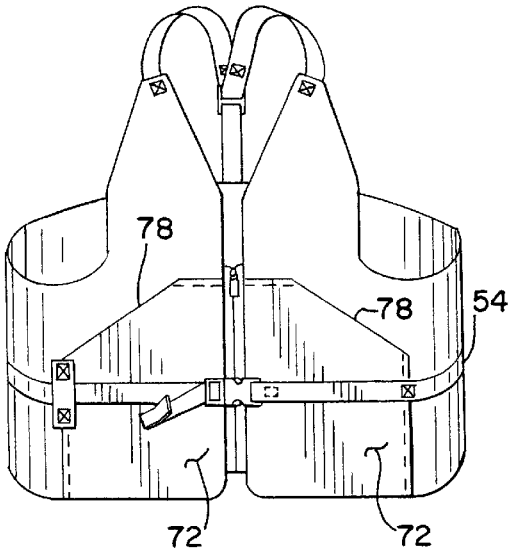
FIG. 7 is a front elevation view of an alternative embodiment of the personal flotation device of FIG. 1 showing alternate front pockets.
Figure 8A:
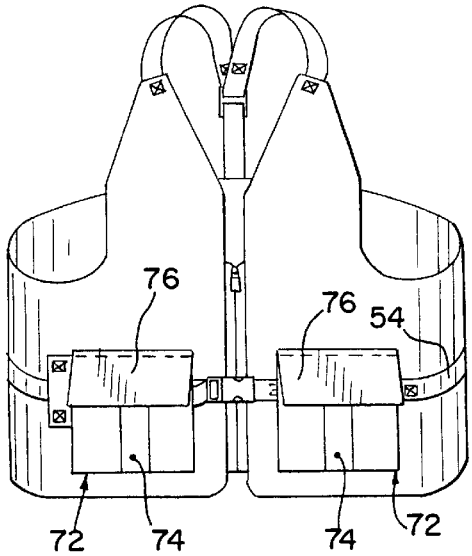
FIGS. 8A and 8B are front elevation views of alternative embodiments of the personal flotation device of FIG. 1 showing alternate front pockets.
Figure 8B:
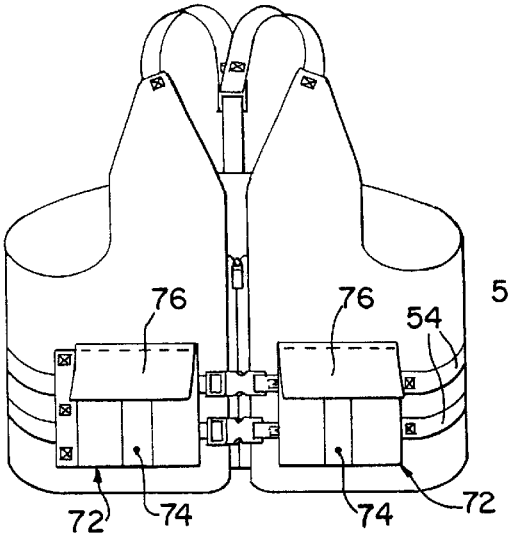
Figure 9:
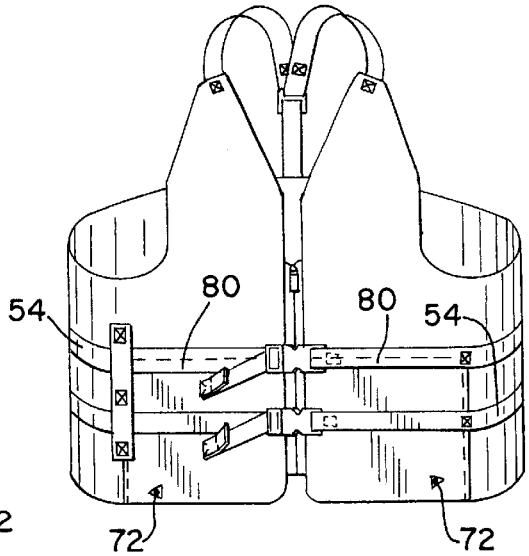
FIG. 9 is a front elevation view of an alternative embodiment of the personal flotation device of FIG. 1 showing alternate front pockets.

FIGS. 6–9 illustrate various different alternative embodiments of the present invention, in which various different double layer gusseted pockets 72 are used in connection with the present invention. FIGS. 6A and 6B show a double layer gusseted pockets 72 having a drain hole 74 and a top flap 76 with a single circumferential strap 54 or a pair of circumferential straps 54. FIG. 7 shows single layer patch pockets 72 with an opening defined along the top angled edge 78. FIGS. 8A and 8B show double layer pleated pockets 72 having a drain hole 74 and top flap 76 with a single circumferential strap 54 or a pair of circumferential straps 54. FIG. 9 shows single layer patch pockets 72 with an opening defined along the top edge 80 disposed under the top circumferential strap 54. It will be understood that the remainder of the PFD as shown in these alternative embodiments of FIGS. 6–9 is in accordance with the present invention as described above.

While the preferred embodiment of the invention have been shown and described, it will be apparent to those skilled in the art that changes and modifications may be made therein without departing from the spirit of the invention, the scope of which is defined by the appended claims. For example, different materials may be substantial for the shell and/or buoyant elements. The closure fasteners such as the zipper and two-part couplers may be configured in any other form to perform the same function and shall not be limited as shown and described.

What is claimed is:

1. A flotation vest, comprising:

a shell including a pair of front parts and a back part cooperatively defining a continuous internal cavity;

each said front part having a torso portion, a lapel portion, a first side and a second side;

said back part interconnecting the first side of each said front part;

a buoyancy means disposed within the internal cavity defined in each said front part torso and lapel portions and said back part;

the second side of each said front part disposed for operative association with said other second side;

a pair of shoulder straps connected to the shell;

each one of said pair of shoulder straps having a fixed length and connected to a free end of each said lapel portion and extending therefrom terminating at a first coupling element such that a neck hole is defined; and, a back strap connected to said back part and extending therefrom to engage said first coupling element such that a pair of oppositely disposed armholes are defined, whereby said vest accommodates various differently dimensioned wearers and provides uninhibited arm motion.

2. The vest as recited in claim 1 wherein said shell further includes an outer fabric layer and an inner fabric layer defining said cavity.

3. The vest as recited in claim 2, wherein said fabric layers are formed of a woven fabric material.

4. The vest as recited in claim 3, wherein said woven fabric material is selected from coated or uncoated nylon, reinforced nylon, polyester, or polypropylene woven fabrics and PVC-reinforced nylon and polypropylene woven fabric materials.

5. The vest as recited in claim 1, wherein said buoyancy means is a synthetic closed cell material.

6. The vest as recited in claim 5, wherein said synthetic material is selected from polyvinyl chloride, polyethylene, and polypropylene foam materials.

7. The vest as recited in claim 1, wherein said first coupling element is variably disposed at a distance from said back element so that said distance varies from juxtaposed to a first end of said back element to a furthest extent of said back strap.

8. The vest as recited in claim 1, further including a device for selectively interconnecting said second edge of each front element.

9. The vest as recited in claim 8, wherein said device includes a zipper.

10. The vest as recited in claim 5, wherein said buoyancy means includes a unitary sheet of material.

11. The vest as recited in claim 1, further including at least one circumferential strap having a releasable closure adapted for affixing said strap about said shell of said vest when disposed on a wearer.

12. The vest as recited in claim 1, further including at least one pocket disposed on at least one of said front elements.

13. A flotation vest, comprising:

a shell including a pair of sheet elements joined to cooperatively form a continuous pocket for receiving a buoyancy means;

said shell having a first end portion, a second end portion and an intermediate portion connecting the first and second end portions;

said first and second end portions each having a first part generally configured to the intermediate portion and a second part formed extending above each first part;

said buoyancy means disposed within the pocket in the first and second parts and the intermediate portion;

each said second part having a strap connected thereto at a free end of the second part opposite the first part;

said straps extend from each said free end to a first coupler defining a neck hole; and, said intermediate portion including an intermediate strap connected thereto and extending therefrom, whereby releasably connecting said intermediate strap and said first coupler defines a pair of armholes in opposition.

14. The vest as recited in claim 13, wherein said elements are formed from a woven fabric.

15. The vest as recited in claim 14, wherein said woven fabric is formed from a synthetic material.

16. The vest as recited in claim 14, wherein said woven fabric may be selected from the group consisting essentially of coated or uncoated nylon, reinforced nylon or polyester, polypropylene woven fabrics, and PVC-reinforced polypropylene woven fabric materials.

17. The vest as recited in claim 13, wherein said buoyancy means includes a plurality of buoyant elements, including a first end buoyant element, a second end buoyant element, and an intermediate buoyant element.

18. The vest as recited in claim 17, wherein said buoyant elements are formed from a synthetic closed cell material.

19. The vest as recited in claim 18, wherein said synthetic closed cell material may be selected from the group consisting essentially of polyvinyl chloride, polyethylene or polypropylene foam materials.

20. The vest as recited in claim 13, wherein said first coupler is disposed at a fixed distance from each said second part.

21. The vest as recited in claim 13, further including a first closure means for selectively connecting and disconnecting said first and second end portions.

22. The vest recited in claim 13, wherein said first closure means includes a zipper.

23. The vest as recited in claim 13, further including at least one circumferentially extending strap having a reclosable second closure means deposed adjacent said first closure means.

24. The vest as recited in claim 13, further including at least one pocket disposed on said shell.

25. The claim as recited in claim 17, wherein said first and second buoyant elements are dimensioned complimentary to said first and second end portions such that said first and second buoyant elements remain disposed therein.

26. The claim as recited in claim 17, wherein a longitudinal extent of said intermediate buoyant element is less than a longitudinal extent of said intermediate portion.

27. The claim as recited in claim 13, wherein said intermediate portion has an elastic band disposed in said pocket associated with a first edge and a second edge of said intermediate portion.

* * * * *